US005398178A

United States Patent [19]

Roth

[11] Patent Number: 5,398,178

[45] Date of Patent: Mar. 14, 1995

[54] REFLECTOR ADAPTOR FOR INDUSTRIAL LUMINAIRE

[75] Inventor: Peter L. Roth, Dallas, Tex.

[73] Assignee: C.E.W. Lighting, Inc., Dallas, Tex.

[21] Appl. No.: 145,747

[22] Filed: Oct. 29, 1993

[51] Int. Cl.[6] ..... F21V 7/00

[52] U.S. Cl. ..... 362/296; 362/341; 362/433; 362/443

[58] Field of Search ..... 362/226, 296, 341, 350, 362/260, 433, 448, 443, 437, 438

[56] References Cited

U.S. PATENT DOCUMENTS

| | | | |
|---|---|---|---|
| 3,379,872 | 4/1968 | Devine, Jr. | 362/443 |
| 3,404,269 | 10/1968 | Schiffer | 240/11.4 |
| 4,237,528 | 12/1980 | Baldwin | 362/263 |
| 4,327,403 | 4/1982 | Capostagno et al. | 362/306 |
| 4,363,086 | 12/1982 | Fletcher | 362/368 |
| 4,403,277 | 9/1983 | Eargle, Jr. et al. | 362/263 |
| 4,628,423 | 12/1986 | Ogle | 362/341 |
| 5,073,845 | 12/1991 | Aubrey | 362/226 |

*Primary Examiner*—Stephen F. Husar
*Attorney, Agent, or Firm*—Dennis T. Griggs

[57] ABSTRACT

An existing luminaire may be updated with an improved reflector by removing the lamp from an existing lighting fixture and inserting a lamp socket extender which is designed to accept a plurality of different configuration reflectors for various types of lamps having selected intensities, diffusion and distribution characteristics. The reflector adaptor eliminates adjustment problems involving the position of the reflector relative the lamp.

11 Claims, 3 Drawing Sheets

REFLECTOR ADAPTOR FOR INDUSTRIAL LUMINAIRE

FIELD OF THE INVENTION

This invention is related generally to luminaires and more specifically to method and apparatus for replacing the reflectors of existing luminaires with high efficiency reflectors without the expense of replacing an entire light fixture or the alternate expense of customizing the reflector attachment to each of many types of conventional light fixture reflector interconnections.

BACKGROUND OF THE INVENTION

In the workplace, light reflectors and diffusers have evolved from a primitive metal reflector to various convoluted shapes of metal reflectors on one side of the light source and associated diffusers on the other. In factories and warehouses where illumination must be provided over a large area, a large number of incandescent fixtures have been used to provide standard levels of illumination. To reduce the total number of lamps needed, a variety of high intensity lamps using mercury, metal halide, high pressure sodium have been developed. In general, such high intensity luminaires are considerably more expensive than the comparable incandescent luminaires.

DESCRIPTION OF THE PRIOR ART

To improve the efficiency and the pattern of light distribution of the high intensity lamps, a large variety of reflectors have been designed in spherical, ellipsoidal and paraboloidal configurations. Attempts have been made to clamp a new reflector either to the lamp socket of the existing fixture or to the existing brackets previously used to hold the reflector. The number of attachment designs for various shaped reflectors is comparable to the number of types of fixtures available. There is no established standard for attaching a reflector to a fixture in a given manner or at a fixed distance from the base of the light socket. Consequently, the various reflectors are not interchangeable.

The operating environment and location of many applications of such commercial luminaires is such that access to the fixture for removal of the reflector for repair or replacement is difficult and often requires that the service worker be standing on a ladder or otherwise be situated in a difficult position to work effectively. In this regard, the problems associated with positioning an improved reflector for attachment to existing flange couplings are particularly aggravated and place the worker in an unsafe situation or at least make it difficult for him to hold a replacement reflector with one hand while attaching it with the other. Moreover, the operating environment of many industrial lighting installations is such that the fixtures are subject to abusive forces in the form of vibration, high wind loads, ice accumulation and corrosion.

Thus, although modern technology has introduced faceted reflectors that greatly improve the efficiency, light distribution characteristics and reduction in glare, the difficulties involved in modifying or customizing attachment brackets of the newly designed reflectors to mate with existing fixtures has resulted in a determination in many installations that it is simpler and less expensive from a man-hour effort or cost standpoint to replace the old ballast or light fixture with a new fixture specifically designed for use with an improved reflector rather than adapt to the old ballast. Thus, a great many facilities have delayed upgrading due not only to the retrofit expense but also because of the time involved, even though it has been well established that substantially fewer fixtures would be needed to produce a given light output at the operating surfaces within the facility and that the operating cost would be reduced.

Since the position of the reflector relative to the lamp is critical to illumination efficiency, it is essential to properly adjust the position of a replacement reflector relative to the lamp. Moreover, vibrational forces occurring in industrial environments will often cause the fasteners used in the adjustable brackets to loosen thereby permitting the reflector to move with respect to the lamp, thus reducing the efficiency of the adapted reflector.

OBJECTS OF THE INVENTION

The principal object of the present invention is to provide apparatus for simply and easily replacing an older style lamp reflector with a more efficient lamp reflector.

A related object of the present invention is to provide a means for installing a more efficient reflector without requiring removal of the existing ballast and mounting brackets.

Another object of the present invention is to provide a reflector adaptor which makes it possible to attach an improved, high efficiency reflector to an existing ballast, thus enabling the use of old but serviceable ballasts while simultaneously reducing energy usage and costs to obtain a prescribed light level.

A further object of the present invention is to make it easy to adapt a given luminaire to changing illumination requirements in an operating area by providing for a simple way to adjust to different wattage lamps, different types of lamps and their associated different size and style reflectors.

Yet another object of the present invention to provide a reflector adaptor for a luminaire which enables ready separation of the lamp and reflector assembly from the ballast housing without electrical hazard to the service personnel.

SUMMARY OF THE INVENTION

The foregoing objects are achieved according to the present invention by a reflector adapter assembly which includes a lamp base compatible with the lamp type of an existing fixture and a socket of the type desired for illumination wherein the socket of the reflector adapter is of the same type socket as previously used in the existing fixture. Sandwiched between the lamp base and the socket of the reflector adapter assembly is a reflector flange surrounding the extender socket. Electrical connections are provided between the lamp base and the extender socket so that, if desired, the existing lamp may be reused with the only change being a reflector of an improved design to be used instead of the reflector originally supplied with the existing fixture.

With the reflector adaptor of the present invention, the original ballast may be used along with its socket. Typically, it does not matter whether or not the existing reflector is removed since the reflector adaptor of the present invention is screwed into or otherwise electrically and mechanically coupled to the existing lamp base connector or lamp socket of the existing fixture.

The reflector adaptor assembly includes an internally threaded, generally bell shaped, conduit housing having a flange which is compatible with a wide variety of styles of improved geometry reflectors such as faceted reflectors. The adaptor is designed with the appropriate spacing from the coupling flange to a compatible lamp in the lamp socket. Improved, high efficiency reflectors may be attached to the reflector flange for use in combination with the original lamp, or with a different lamp. An associated retainer flange with its externally threaded conduit may be screwed into place to compress the top of the improved reflector between the respective flanges wherein it is optimally situated with respect to a lamp of choice.

Operational features and advantages of the present invention will be understood by those skilled in the art upon reading the detailed description which follows with reference to the attached drawings.

DETAILED DESCRIPTION OF THE PREFERRED EMBODIMENT

Figure 1:
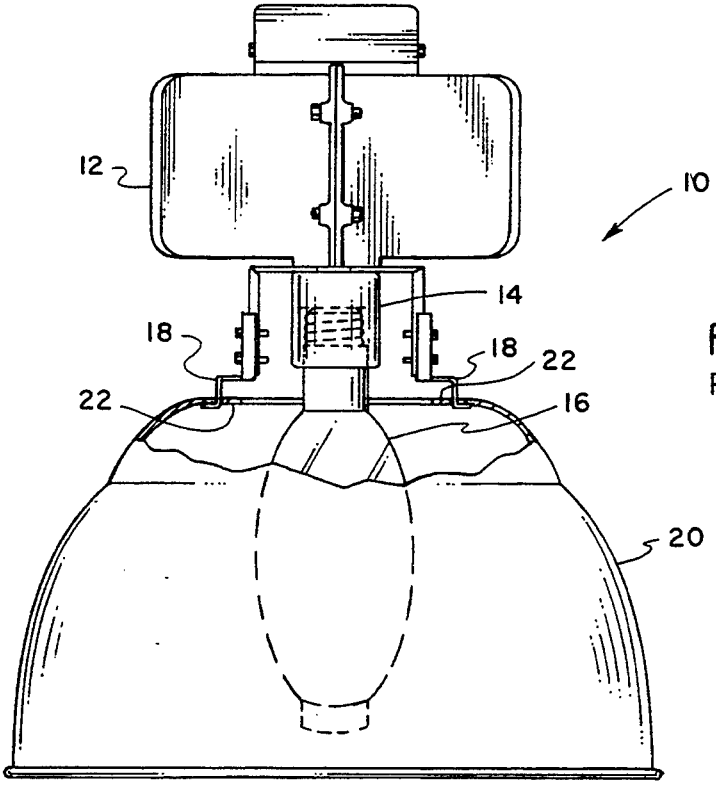
FIG. 1 PRIOR ART
FIG. 1 is a side elevational view, partially broken away, of a conventional luminaire including a ballast, a lamp socket, reflector and lamp.

In the description which follows, like parts are indicated throughout the specification and drawings with the same reference numerals, respectively. The drawings are not necessarily to scale, and the proportions of certain parts have been exaggerated to better illustrate details of the present invention.

In FIG. 1 a prior art luminaire or light fixture including reflector is shown and generally indicated as 10 and includes a ballast 12, a lamp socket 14 for the existing fixture, a lamp 16 and reflector brackets 18 comprising a part of the fixture and used for retaining a reflector 20. There are openings 22 in the reflector 20 that accommodate the brackets 18. By forcing the two brackets 18 in an inward direction, the reflector 20 may be disassembled from the remainder of the assembly so that the reflector 20 may be cleaned or replaced by another reflector having the same openings 22 spaced in the same manner for attachment to the remaining or existing portions of luminaire 10. As will be realized by those skilled in the art, the bottom of the brackets 18 position the reflector 20 at the optimum vertical distance from socket 14 to accomplish a coincidence between the lamp 16 and the reflector 20.

Figure 2:
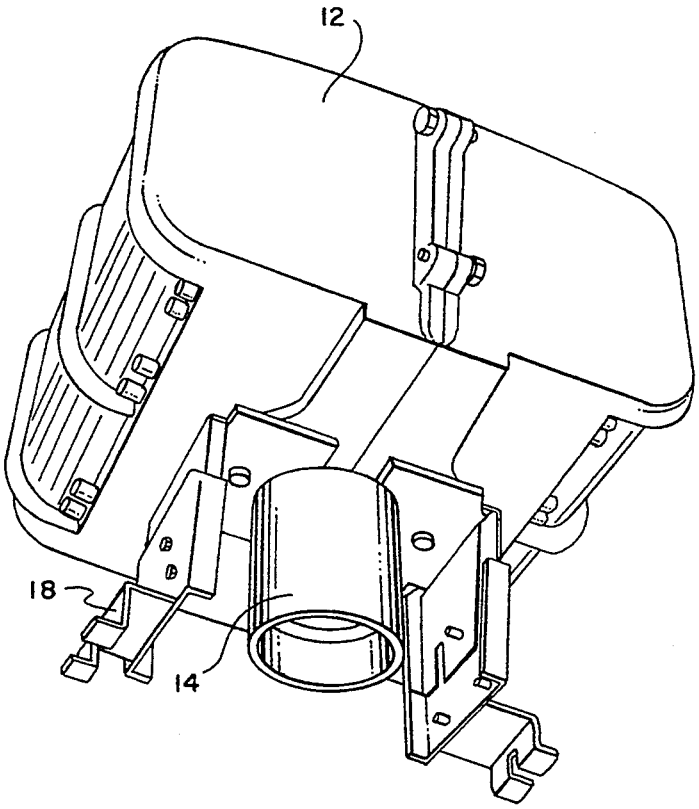
FIG. 2 is a perspective view of the ballast, lamp socket and reflector bracket of FIG. 1.

FIG. 2 is a view of the underside of the light fixture 10 of FIG. 1 with the lamp 16 and the reflector 20 removed.

Figure 3:
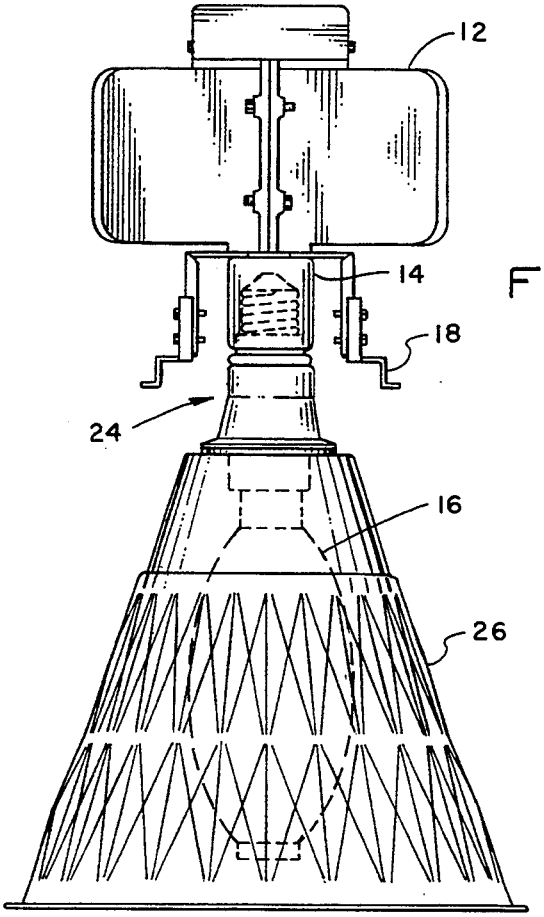
FIG. 3 is a side elevational view of the ballast and socket of FIG. 2 including a reflector adaptor assembly of the present invention and an appropriate reflector of an improved, faceted design.

FIG. 3 illustrates the apparatus as disclosed in FIG. 2 with the addition of a reflector adaptor assembly 24 which is coupled to the lamp socket 14 of the existing ballast and the lamp 16 previously used and inserted into a socket of the reflector adaptor assembly 24. Attached to the reflector adaptor assembly 24 is a high efficiency reflector 26 of a new or improved design as compared to the original reflector 20.

Figure 4:
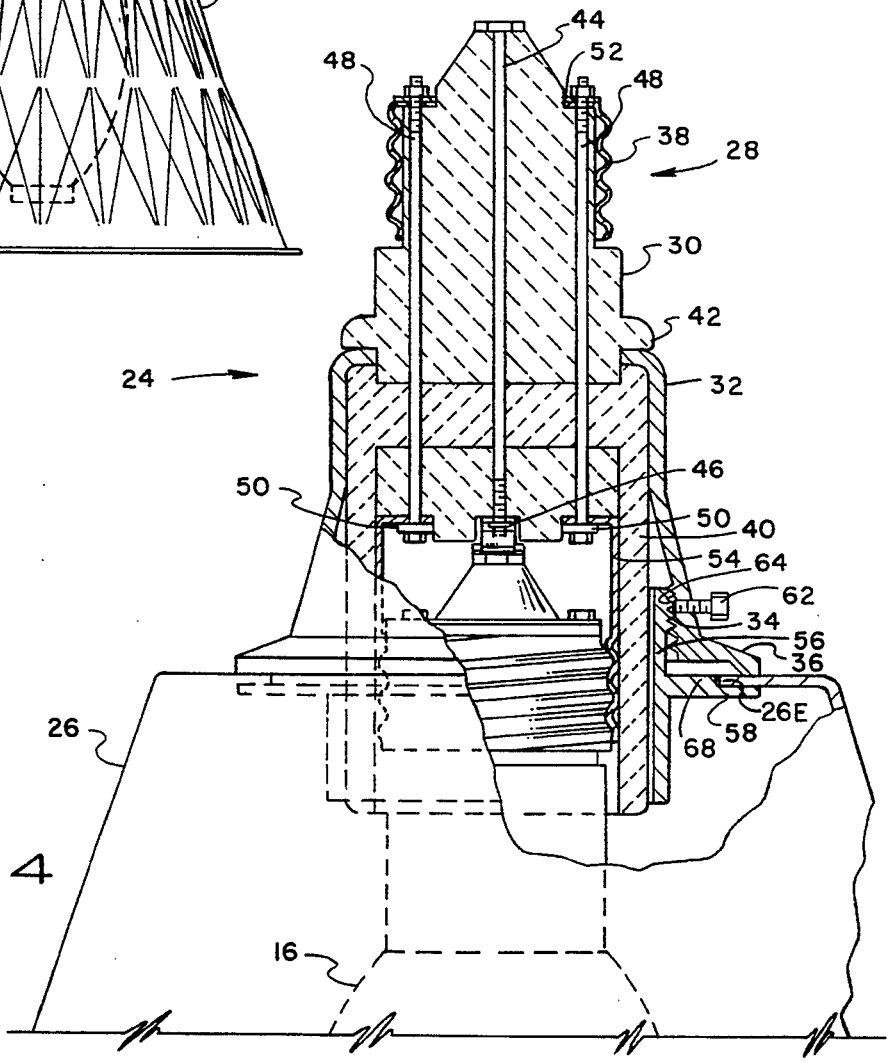
FIG. 4 is a enlarged elevational view, partially in section, of the adaptor portion of FIG. 3 which shows the internal parts in more detail.

In FIG. 4, an expanded detail and break-away view of the reflector adaptor assembly 24 of FIG. 3 is illustrated with a threaded base generally indicated as 28 including an insulating spacer 30. A generally bell-shaped housing 32 which includes a female threaded conduit, a reflector coupling flange and reflector clamp, is shown in contact with the spacer 30. The bell-shaped housing 32 includes a set of internal threads 34 and an annular flange 36 extending from the internally threaded area 34. On the outside surface of the insulating spacer 30, there is a threaded electrical contact 38 which includes a portion of the lamp base 28. Inside the housing 32 and comprising a portion of the reflector adaptor assembly 24 is an insulating socket housing 40. The insulating spacer 30 further has a annular ring or shoulder 42.

The housing 32, which is curved radially inwardly at its upper end, is sandwiched between the shoulder 42 and the base or upper end of socket housing 40 so that the housing 32 cannot move vertically or in rotation. A threaded bolt fastener 44 passes from the tip of lamp base 28 through the insulating spacer 30 to a threaded opening in a spring contact 46 within the lamp socket portion of the reflector adaptor assembly 24. The spring contact 46 is constructed similarly to the spring contact in a conventional incandescent lamp fixture. A pair of threaded bolt fasteners 48 have their heads confined within the socket portion of the lamp extender 24 and pass through load distributing washers 50, the socket housing 40 and the spacer 30 before being threadedly engaged with screw threads in appropriate openings in a retainer 52.

As will be observed, the bolt 44 provides both mechanical compression to retain bell shaped housing 30 in place and in combination with spring contact 46 provides electrical connection between the central contact of bulb 16 and the central contact of socket 14 of the existing fixture being updated. Likewise, the bolts 48 provide electrical contact between the conductive and threaded side portions of the socket 14 and similar side portion threaded contacts 54 within the insulator socket housing 40. The threaded contacts 54 are preferably of the same design as in the socket 14, but need not be if the ballast 12 has voltages and currents compatible with a new lamp that has a different base configuration.

The reflector 26 is held in place by compressive forces between a set of flanges 36, 58. A male threaded conduit, reflector retainer flange or reflector flange retainer 56 has a set of external threads 64 which are compatible with threads 34 of housing 32. It also has an annular flange 58 for the purpose of securing the reflector 26 to the reflector adaptor assembly 24.

To further prevent the flange 56 from being accidentally released due to vibration, an additional securing device is shown in the form of a set screw 62. The set screw 62 provides a compressive force onto the external threads of the reflector retainer 56 and prevents the retainer 56 from release until the set screw 62 is removed. It may also be observed that the conduit forming a portion of reflector retainer 56 has an inside diameter slightly greater than the outside diameter of the socket housing 40 so that the reflector 26 may be disassembled at any time without interfering with the remaining portions of reflector adaptor assembly 24.

Figure 5:
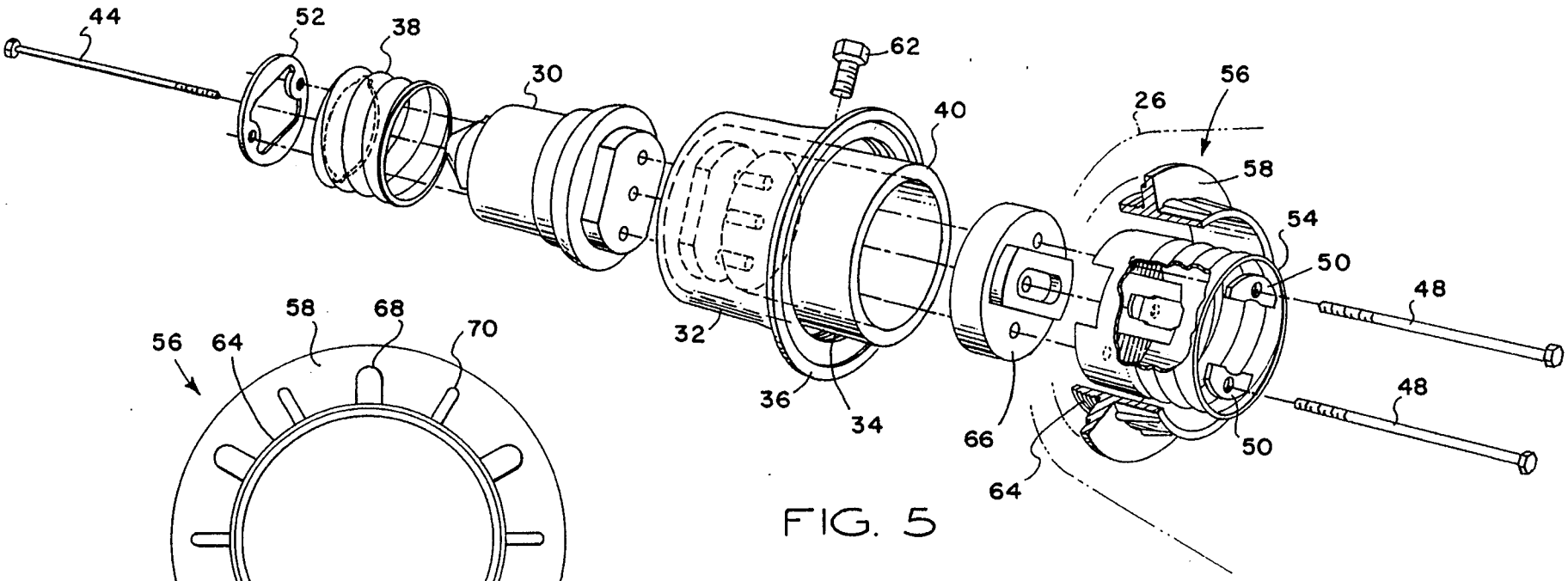
FIG. 5 is an exploded perspective view of the adaptor assembly used in the present invention; and, FIG. 6 is a plan view of the reflector retainer shown in FIG. 4 and FIG. 5.

FIG. 5 illustrates an exploded view of the apparatus of FIG. 4 which reveals an insulator spacer 66 which is contained within the upper portion of the socket housing 40. While the socket insulator housing 40 and the spacer 66 could be machined or cast as one piece, they are preferably made in two separate pieces in the preferred embodiment for ease of manufacture.

Figure 6:
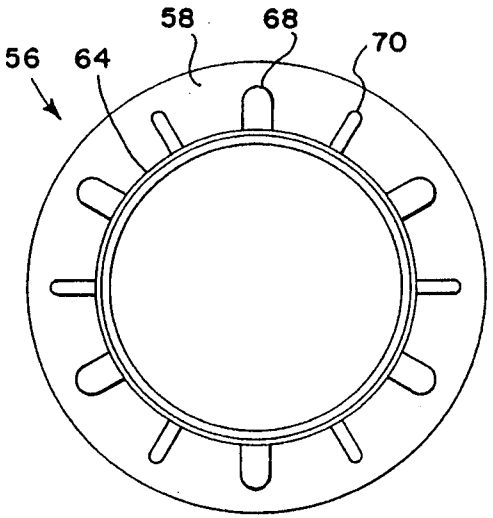

FIG. 6 shows a top view of the reflector retainer 56 with the external threads 64 and the annular flange 58. In addition, the flange 58 has a centering boss formed by ribs 68 and 70 for registration within a central opening in the coupling collar portion 26E of the reflector 26. The ribs 68 fit in flush registration against the inside coupling edge 26E of the reflector (FIG. 4), thereby providing precise centering of the reflector 26 relative to the auxiliary lamp socket housing 40. By this centering arrangement, the lamp 16 is properly positioned and centered radially within the cavity of the replacement reflector 26.

From the above, it will be apparent that existing ballasts 12 may be salvaged and re-used rather than discarded simply by connecting the reflector adaptor assembly 24 into the socket 14 of the existing lamp socket. Further, since a large majority of these lamp sockets are of the mogul type, a single adaptor will fit most existing units. In any event, it would be a simple matter to alter the shape of base 28 to fit other desired lamp sockets. Since the flange 36 of housing 32 is a predetermined distance from the lamp socket portion of the reflector adaptor assembly 24, an improved reflector such as 26 may easily be selected and installed once a determination is made as to the illumination distribution characteristics to be provided, the wattage of the lamp to be used, and the bulb type.

An improved high efficiency reflector may readily be installed without removing the existing reflector if so desired since the reflector adaptor 24 will place the new reflector far enough in a downward direction that it will not in any way contact the existing reflector. The operator has the option to either remove the original reflector or leave it in place. Conventional lamp removal equipment may still be used to replace the lamp, provided a safety chain is connected between the new reflector and the ballast assembly.

Although the invention has been described and illustrated with respect to a preferred embodiment, it should be understood that the present disclosure has been made by way of example only and that changes in the arrangement and combination of parts may be made by those skilled in the art without departing from the spirit and scope of the invention as claimed.

What is claimed is:

1. A light fixture comprising, in combination:

a ballast and lamp socket electrically coupled to the ballast;

a lamp socket extender including a lamp base having electrical contacts matable with the lamp socket of the ballast, the extender lamp socket being electrically connected to the electrical contacts of the lamp base, and a housing clamped intermediate the lamp base and the extender lamp socket, the housing including internal threads disposed adjacent the extender lamp socket and including an annular flange;

a light reflector coupled to the annular flange; and a reflector retainer, including a conduit portion and an annular flange extending from the conduit portion, the conduit portion having external threads matable with the internal threads of the housing, and the annular flange of the reflector retainer holding the reflector in place against the annular flange of the housing.

2. Apparatus for securing a reflector of the type having a coupling collar to an existing light fixture having a lamp socket comprising, in combination:

a lamp base adapted for mating electrical contact with the lamp socket of an existing lamp fixture, the lamp base including an insulating spacer with a seat remote from the electrical contacts of the lamp base;

a first coupling flange having a recessed base with an opening therein contiguous the seat of the insulating spacer and having an internal set of threads remote from the recessed base, the internal set of threads defining an opening of a predetermined size, and the coupling flange including an annular flange extending radially from the internal set of threads;

an auxiliary lamp socket disposed within the recessed base opening of the first coupling flange;

mechanical fasteners electrically and mechanically interconnecting the auxiliary lamp socket to the lamp base and securing the first coupling flange and the insulating spacer therebetween; and a second coupling flange having external threads engaging the internal threads of the first coupling flange for securing a new reflector to an existing light fixture.

3. Apparatus as defined in claim 2 comprising, in addition:

a reflector secured between the first and second coupling flanges.

4. Apparatus as defined in claim 2, the second coupling flange having a centering boss portion for registration within the coupling collar of the new reflector.

5. Luminaire apparatus comprising, in combination:

a ballast and a lamp socket electrically coupled to the ballast;

a lamp socket extender including a lamp base having electrical contacts matable with the lamp socket of the ballast, an extender lamp socket electrically connected to the electrical contacts of the lamp base, and a housing mechanically clamped intermediate the lamp base and the extender lamp socket, the housing including internal threads adjacent the outside of the extender lamp socket and an annular flange contiguous said internal threads;

a reflector positioned against the annular flange; and, a conduit including external threads matable with the internal threads and an annular flange, the conduit being screwed into said internal threads to retain the reflector in place between the flange of the housing and the flange of the conduit.

6. A lamp socket extender comprising, in combination:

a lamp base including electrical contacts compatible with a lamp socket of a fixture to be utilized;

an extender lamp socket electrically connected to the electrical contacts of the lamp base;

reflector clamp situated intermediate said lamp base and the extender lamp socket, the reflector clamp including internal threads adjacent the outside of the extender lamp socket and an annular flange contiguous the internal threads; and a reflector retainer flange including external threads compatible with the internal threads, the action of screwing the external threads of the retainer flange into the internal threads of said reflector clamp operating to retain a reflector in place therebetween.

7. Apparatus as defined in claim 6 comprising, in addition:

a reflector having a light projection outlet opening and a smaller coupling collar opening wherein the coupling collar opening is slightly larger than the diameter of the internal threads and is positioned against the annular flange of the reflector clamp and between that flange and the reflector retainer flange.

8. Apparatus as defined in claim 7 comprising, in addition:

ribs disposed on a side surface of the reflector retainer flange for mating engagement with pockets formed in the reflector coupling collar.

9. Apparatus as defined in claim 7 comprising, in addition:

ribs disposed on a side surface of the reflector retainer flange for centering a reflector relative to the extender lamp socket.

10. The method of attaching a new reflector to an existing light fixture comprising the steps of:

providing a lamp socket extender having at one end a set of male contacts mateable with a set of female contacts in an existing light fixture to be updated and having at the other end a female threaded reflector flange and a lamp socket;

positioning an opening the coupling collar of a reflector to be contiguous with the female threaded reflector flange;

securing the reflector to the socket extender by threadedly engaging a male reflector flange to the female threaded reflector flange;

inserting a lamp into the lamp socket; and screwing the assembled combination into the socket of an existing fixture in place of an original lamp.

11. The method of attaching a new reflector as recited in claim 10 including the steps of:

unscrewing the original reflector retainer;

replacing the original reflector with a new reflector having a coupling collar while providing a different light distribution geometry; and securing the coupling collar between the male and female reflector flanges.

* * * * *